US008563497B2

(12) United States Patent
Hodson

(10) Patent No.: US 8,563,497 B2
(45) Date of Patent: Oct. 22, 2013

(54) PROCESS FOR MAKING A DETERGENT BASED COMPOSITION

(75) Inventor: Stephen Joseph Hodson, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/084,812

(22) Filed: Apr. 12, 2011

(65) Prior Publication Data

US 2011/0252574 A1 Oct. 20, 2011

Related U.S. Application Data

(60) Provisional application No. 61/325,404, filed on Apr. 19, 2010.

(51) Int. Cl.
*C11D 17/00* (2006.01)

(52) U.S. Cl.
USPC ..... 510/424; 510/426; 510/428; 510/492

(58) Field of Classification Search
None
See application file for complete search history.

(56) References Cited

U.S. PATENT DOCUMENTS 4,056,113 A * 11/1977 Johnson et al. ..... 134/40

FOREIGN PATENT DOCUMENTS

WO WO95/14071 5/1995

OTHER PUBLICATIONS

Search Report and Written Opinion from the International Searching Authority, mailed on Aug. 19, 2011, International Application No. PCT/US2011/032419, 9 pages.

* cited by examiner

*Primary Examiner* — Necholus Ogden, Jr.
(74) *Attorney, Agent, or Firm* — Melissa G. Krasovec; Steven W. Miller

(57) ABSTRACT

A process for making an anhydrous laundry liquid detergent base composition comprising detersive surfactant, the process comprising the steps of:

a) providing a pre-neutralized sulphate detersive surfactant syrup wherein at least 50% of the sulphate detersive surfactant is pre-neutralized with an organic neutralizing agent;
b) adding a neutralizing agent to the sulphate detersive surfactant syrup; and
c) adding a sulphonic detersive surfactant in acid form to the mixture resulting from step b).

12 Claims, No Drawings

PROCESS FOR MAKING A DETERGENT BASED COMPOSITION

CROSS REFERENCE TO RELATED APPLICATION

This application claims the benefit of U.S. Provisional Application Ser. No. 61/325,404, filed Apr. 19, 2010.

FIELD OF THE INVENTION

The present invention relates to a process for making a liquid detergent base composition, a detergent comprising the base composition and a method of laundering using the detergent.

BACKGROUND OF THE INVENTION

Recent liquid laundry detergent consumer preferences towards smaller more concentrated product forms have resulted in the liquid detergent formulators handling a whole series of different constraints. In addition, not only do consumers want smaller compacted liquid laundry detergent products but the consumers also want these compacted products to have the same performance as traditional uncompacted liquid laundry detergents; this is an extremely difficult consumer need to meet.

Compacted liquid laundry detergent products have less space to incorporate detergent ingredients; this places great constraint on the detergent formulator, especially for restricting the levels of the bulk detergent ingredients like surfactants, builders and solvents that take up much of the formulation space. For the detergent ingredients that are incorporated into these compacted liquid laundry detergent products, the detergent formulator must greatly improve the efficiency of these detergent ingredients, and of the compacted liquid laundry detergent composition as a whole.

As well as ensures such compacted liquid laundry detergents have good cleaning performance, the detergent formulator must also ensure that such products have good product storage stability profile, and desirable rheological properties to ensure that the product can be handled and dosed easily by the consumer.

An additional problem associated to compacted detergents is the manufacture process. The reduction of ingredients, such as solvents can give rise to undesired phase formation in the base composition, such as surfactant middle phases that are difficult to process.

Sometimes, it is desirable to make a base detergent composition which can be diluted to make finished detergent compositions rather than making different finished products from the beginning. From a process efficiency view point it would be beneficial to have a common base composition that can be later on differentiated to give rise to different products. Very often this is not possible because the post-addition of solvent or late differentiation additives to the base composition would alter the rheology of the composition making it unmanageable.

The aim of the present invention is to overcome the above described drawbacks.

SUMMARY OF THE INVENTION

According to a first aspect of the invention, there is provided a process for making an anhydrous laundry liquid detergent base composition. By "anhydrous composition" is herein understood a composition having preferably less than 30%, more preferably less than 20% and especially less than 10% of water by weight thereof. By "base composition" is herein understood a composition that can be used either as a finished detergent product or preferably as a building block for a finished detergent product.

The process of the invention comprises the steps of:

a) providing a pre-neutralized sulphate detersive surfactant syrup wherein at least 50%, preferably at least 60%, more preferably at least 70% and especially 100% of the sulphate detersive surfactant is pre-neutralized with an organic neutralizing agent, preferably with mono-ethanol amine;

b) adding a neutralizing agent to the pre-neutralized sulphate detersive surfactant syrup; and c) subsequently adding a sulphonate detersive surfactant in acid form.

By "pre-neutralized surfactant" is herein understood a surfactant that has been neutralized before it takes part in the process for making the detergent base composition, as opposite to be neutralized during the process for making the detergent base composition.

Many of the sulphate detersive surfactants are not very stable in the acid form, preferably they are neutralized just after the acid form is produced. Furthermore the sulphate detersive surfactant, even after it has been neutralized, can be instabilized by the presence of acid. It has been found that by adding neutralizing agent to the pre-neutralized sulphate detersive surfactant syrup (in addition to the neutralizing agent added for the pre-neutralization) before any other acidic material the stability of the sulphate detersive surfactant is enhanced.

Step c) is performed after steps a) and b) thus the pre-neutralized sulphate detersive surfactant is protected from the acid by the neutralizing agent.

In a preferred embodiment the sulphate detersive surfactant is selected from alkyl alkoxylated sulphates, mid-chain branched primary alkyl sulphates and mixtures thereof. Preferably the sulphate detersive surfactant comprises an alkyl ethoxylated sulphate, more preferably a $C_{8-18}$ alkyl ethoxylated sulphate having an average degree of ethoxylation of from 0.5 to 10, preferably from 0.5 to 7, more preferably from 0.5 to 5 and most preferably from 0.5 to 4.

In preferred embodiments the sulphate detersive surfactant comprises a mixture of an alkyl alkoxylated sulphate, preferably a $C_{8-18}$ alkyl ethoxylated sulphate and a mid-chain branched primary alkyl sulphate wherein the alkyl alkoxylated sulphate and the mid-chain branched primary alkyl sulphate are in a weight ratio of at least 2:1, preferably at least 4:1 and especially in a ratio of at least 5:1.

At least 50%, preferably at least 70%, more preferably at least 90% and especially 100% of the sulphate detersive surfactant present in the syrup has been pre-neutralized with an organic neutralizing agent. The organic neutralizing agent is preferably an alkanolamine. It can be a primary, secondary or a tertiary amine. Mono-ethanolamine (MEA) is the preferred alkanolamine for use herein. The use of an organic neutralizing agent, preferably mono-ethanolamine, avoids or reduces the use of water (as compared to inorganic neutralizing agents) and contributes to the reduction of volume of the base composition as well as to a favorable rheology of the resulting base composition. These two factors (volume reduction and favorable rheology) are critical for the preparation of a compact detergent.

In a preferred embodiment the pre-neutralized sulphate detersive surfactant syrup comprises an organic solvent, preferably a non-amino functional solvent. This further contributes to the good rheological profile of the resulting detergent base. Preferred non-amino functional solvents for use herein include primary alcohols, glycols and mixtures thereof. Especially preferred non-amino functional solvent is a mixture comprising ethanol and propylene glycol.

In preferred embodiments the process of the invention comprises the step of adding an organic solvent after step a) and preferably before step b). This organic solvent can be the same or different to that in the pre-neutralized sulphate detersive surfactant syrup. Preferred organic solvent for use herein is a non-amino functional solvent, including alcohols, glycols and mixtures thereof. Especially preferred organic solvent to be added between step a) and b) is a mixture comprising ethanol propylene glycol and diethylene glycol.

The addition of the organic solvent between steps a) and b) further contributes to reduction of the water in the composition and consequently to the reduction of volume and to a favorable rheology of the resulting base composition.

The neutralizing agent of step b) can be selected from organic neutralizing agents, inorganic neutralizing agents and mixtures thereof. This neutralizing agent can be the same or different to that in the pre-neutralized sulphate detersive surfactant syrup. This neutralizing agent is preferably an alkanolamine, more preferably mono-ethanolamine (MEA), providing the benefits cited herein above.

In preferred embodiments more than 50%, preferably more than 60% and especially more than 70% of the anionic surfactant in the base composition (i.e. sulphate and sulphonate detersive surfactant) is sulphate detersive surfactant. In a preferred embodiment the sulphate detersive surfactant and the sulphonate detersive surfactant are in a weight ratio of from about 4:1 to about 1:1.

The detergent base preferably comprises from 0% to 5%, more preferably less than 2% and especially less than 1% by weight of the base of citric acid and any other materials that have a large sphere of hydration associated to them. The detergent base delivers similar amounts of actives to those delivered in traditional detergents in a smaller dose size and because the water content is lower some chemistry that is not necessarily compatible with or in higher water content products can be made compatible in lower water products.

According to a second aspect of the invention, there is provided a process for making a laundry liquid detergent comprising post-adding to the base composition obtainable and preferably obtained by the process of the first aspect of the invention from about 5 to about 20% of water by weight of the detergent. The base composition obtainable, and preferably obtained, by the process of the first aspect of the invention is robust enough to withstand water addition without negatively influencing the rheology profile of the base composition.

According to a product aspect of the invention, there is provided a laundry detergent obtainable and preferably obtained according to the process of the first or second aspect of the invention.

The detergent is quite compact thereby allowing for the delivery of a very small dose (volume wise) providing good cleaning results. Typical volumes of compacted detergents are below 30 ml, more preferably below 25 ml. The detergent also has a good rheological profile.

According to the last aspect of the invention, there is provided a method of laundering fabric comprising the step of contacting the fabric in a laundry washing machine with a wash liquor comprising from about 0.2 to about 1 g/l, preferably from about 0.3 to about 0.8 g/l, of the detergent of the invention.

DETAILED DESCRIPTION OF THE INVENTION

The present invention envisages a process for making a detergent base composition, preferably a laundry liquid detergent base composition. It also envisages a detergent composition obtainable according to the process of the invention, and a method of laundering a fabric using the detergent composition. The process gives rise to a base composition that is very versatile in terms of post-addition of ingredients and presents a good rheological profile. The base can be used to generate a concentrated detergent, i.e., a detergent with high level of active ingredients, or it can be further diluted if desired.

Process for Making the Base Composition

The process starts with a pre-neutralized sulfate detersive surfactant syrup. Preferably the syrup comprises an organic solvent, more preferably a non-amino functional solvent.

Optionally an organic solvent is added to the pre-neutralized sulfate detersive surfactant syrup and then the neutralizing agent is added. Once these ingredients are in a mixing tank mixing is commenced and the rest of the ingredients are added with agitation, the rest of the ingredients include brightener, non-ionic surfactant, dispersant polymer, surfactancy boosting polymer, chelant, etc. The temperature of the mixture is below 37° C. (this is achieved by cooling if the temperature of the mixture is above 37° C.). Finally the sulphonic detersive surfactant is added to create the detergent base. The detergent base can be converted into a fully formulated detergent by the addition of other detergent ingredients such as enzymes and suds suppressors.

Preferred sulfate detersive surfactant for use herein includes alkoxylated and/or un-alkoxylated alkyl sulfate materials.

Preferred alkoxylated alkyl sulfate materials comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$-$C_{20}$ alkyl group, n is from about 1 to 20, and M is a salt-forming cation. Preferably, R' is $C_{10}$-$C_{18}$ alkyl and n is from about 1 to 15. Most preferably, R' is a $C_{12}$-$C_{16}$ and n is from about 1 to 6.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Preferred un-alkoxylated alkyl sulfate materials include mid-branched primary alkyl sulfate surfactants having an average carbon chain length of from about 14 to about 17 ("MBAS surfactants"). They provide good cleaning properties. MBAS surfactants with a carbon chain length of about 16 to 17 (also referred to as "HSAS surfactants") generally provide better cleaning than those of other chain-lengths.

Preferably the pre-neutralized sulfate detersive surfactant comprises a $C_{8-18}$ alkyl ethoxylated sulphate having an average degree of ethoxylation of from 0.5 to 10, preferably from 0.5 to 7, more preferably from 0.5 to 5 and most preferably from 0.5 to 6. At least 50%, preferably at least 70% and especially 100% of the surfactant has being neutralized with mono-ethanol amine. In some embodiments, the pre-neutralized sulfate detersive surfactant comprises a HSAS surfactant. In other embodiments the pre-neutralized sulfate detersive surfactant comprises a mixture of an alkyl ethoxylated sulphate with a HSAS surfactant, preferably the alkyl ethoxylated sulphate and the HSAS surfactant are in a weight ratio of at least 2:1, more preferably at least 5:1 and specially at least 10:1. Preferably at least 50%, more preferably at least 70% and especially at least 90% of the sulfate detersive surfactant is neutralized with mono-ethanolamine.

Preferably the pre-neutralized sulfate detersive surfactant syrup comprises a non-aminofunctional solvent. As used herein, "non-aminofunctional solvent" refers to any solvent which contains no amino functional groups. Non-aminofunctional solvent include, for example: C1-C8 alkanols such as methanol, ethanol and/or propanol and/or 1-ethoxypentanol; C2-C6 diols; C3-C8 alkylene glycols; C3-C8 alkylene glycol mono lower alkyl ethers; glycol dialkyl ether; lower molecular weight polyethylene glycols; C3-C9 triols such as glycerol; and mixtures thereof. More specifically non-aminofunctional solvent are liquids at ambient temperature and pressure (i.e. 21° C. and 1 atmosphere), and comprise carbon, hydrogen and oxygen. When present, non-aminofunctional solvent may comprise from about 0% to about 25%, more specifically from about 1 to about 20%, even more specifically from about 5% to about 15% by weight of the syrup. The addition of the non-aminofunctional solvent would contribute to the favorable rheological profile of the base composition.

Preferred sulphonic detersive surfactant is a $C_{10-16}$ alkyl benzene sulfonic acid, preferably $C_{11-14}$ alkyl benzene sulfonic acid. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383.

Detergent Composition

Detersive Surfactant

Compositions suitable for use herein comprises from 5% to 70% by weight, preferably from 10% to 60% by weight, more preferably from 20% to 50% by weight, of a certain kind of detersive surfactant component. Such an essential detersive surfactant component must comprise anionic surfactants (sulphate and sulphonic detersive surfactants as described herein before), nonionic surfactants, or combinations of these two surfactant types. Preferably the detergent comprises from about 10% to about 40%, preferably from about 15% to 30% by weight of the detergent of an alkoxylated sulfate detersive surfactant. Preferably the detergent comprises from 5% to 20%, more preferably from 7 to 15% by weight of the detergent of a sulphonate detersive surfactant. Preferably the detergent comprises from 0.1% to 10%, more preferably from 1 to 5% by weight of the detergent of a non-ionic detersive surfactant. Preferably the detergent comprises from 0 to 10%, more preferably from 1 to 5% by weight of the detergent of a fatty acid.

Suitable nonionic surfactants useful herein can comprise any of the conventional nonionic surfactant types typically used in liquid detergent products. These include alkoxylated fatty alcohols, ethylene oxide (EO)-propylene oxide (PO) block polymers, and amine oxide surfactants. Preferred for use in the liquid detergent products herein are those nonionic surfactants which are normally liquid.

Preferred nonionic surfactants for use herein include the alcohol alkoxylate nonionic surfactants. Alcohol alkoxylates are materials which correspond to the general formula:

$$R^1(C_mH_{2m}O)_nOH$$

wherein $R^1$ is a $C_8$-$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol and Dobanol by the Shell Chemical Company.

Another type of nonionic surfactant which is liquid and which may be utilized in the compositions of this invention comprises the ethylene oxide (EO)-propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents, 7th Ed.*; Longman Scientific and Technical (1987) at pp. 34-36 and pp. 189-191 and in U.S. Pat. Nos. 2,674,619 and 2,677,700.

Yet another suitable type of nonionic surfactant useful herein comprises the amine oxide surfactants. Amine oxides are materials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide. Preferably the detergent of the invention comprises from about 0.5% to about 5%, more preferably from 0.8% to 3% by weight of the detergent of an amine oxide surfactant.

In the liquid detergent compositions herein, the essential detersive surfactant component may comprise combinations of anionic and nonionic surfactant materials. When this is the case, the weight ratio of anionic to nonionic is at least 2:1, preferably 5:1 and especially 10:1. The detergent composition comprises from 0% to 5%, more preferably less than 2% and especially less than 1% by weight of the detergent of citric acid. It is also preferred that the detergent composition has a low level (i.e. below 5% and more preferably below 2% by weight of the detergent) or it is free of fatty acid.

Preferably the liquid detergent compositions herein have a pH of from about 7 to about 9, more preferably from 8 to 8.5 as measured in 5% aqueous solution at 20° C.

Laundry Washing Adjuncts

The detergent compositions herein, preferably in liquid form, comprise from 0.1% to 30% by weight, preferably from 0.5% to 20% by weight, more preferably from 1% to 10% by weight, of one or more of certain kinds of laundry washing adjuncts. Such laundry washing adjuncts can be selected from detersive enzymes, builders, chelants, soil release polymers, soil suspending polymers, optical brighteners, dye transfer inhibition agents, bleach, whitening agents, suds suppressors, fabric care benefit agents, solvents, stabilizers, buffers, structurants, dyes and perfumes and combinations of these adjunct types. All of these materials are of the type conventionally utilized in laundry detergent products.

The composition preferably comprises from 1 to 10% by weight of the composition of polymer. Suitable polymers include dispersant polymers such as polyamines, preferably polyethylene imines, most preferably alkoxylated polyethylene imines, preferably the composition comprise from about 1% to about 5% by weight of the composition of an alkoxylated polyethylene imine.

Other preferred polymers include surfactancy boosting polymer. The composition may comprise a surfactancy boosting polymer. Preferred polymers are amphiphilic alkoxylated grease cleaning polymers and/or random graft co-polymers. Amphiphilic alkoxylated grease cleaning polymers refer to any alkoxylated polymers having balanced hydrophilic and hydrophobic properties such that they remove grease particles from fabrics and surfaces. Specific embodiments of the amphiphilic alkoxylated grease cleaning polymers suitable for use herein comprise a core structure and a plurality of alkoxylate groups attached to that core structure.

The core structure may comprise a polyalkylenimine structure comprising, in condensed form, repeating units of formulae (I), (II), (III) and (IV):

(I)

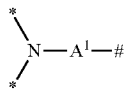

(II)

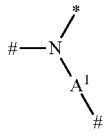

(III)

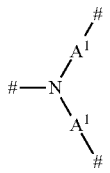

(IV)

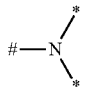

wherein # in each case denotes one-half of a bond between a nitrogen atom and the free binding position of a group $A^1$ of two adjacent repeating units of formulae (I), (II), (III) or (IV); * in each case denotes one-half of a bond to one of the alkoxylate groups; and $A^1$ is independently selected from linear or branched $C_2$-$C_6$-alkylene; wherein the polyalkylenimine structure consists of 1 repeating unit of formula (I), x repeating units of formula (II), y repeating units of formula (III) and y+1 repeating units of formula (IV), wherein x and y in each case have a value in the range of from 0 to about 150; where the average weight average molecular weight, Mw, of the polyalkylenimine core structure is a value in the range of from about 60 to about 10,000 g/mol.

The core structure may alternatively comprise a polyalkanolamine structure of the condensation products of at least one compound selected from N-(hydroxyalkyl)amines of formulae (I.a) and/or (I.b), (I.a)

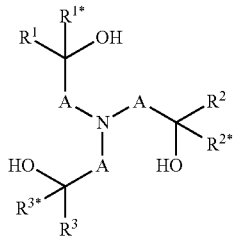

(I.b)

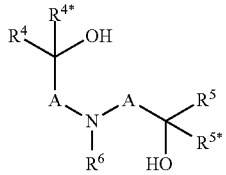

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted.

The plurality of alkylenoxy groups attached to the core structure are independently selected from alkylenoxy units of the formula (V)

(V)

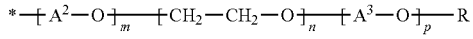

wherein * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50.

Specific embodiments of the amphiphilic alkoxylated grease cleaning polymers may be selected from alkoxylated polyalkylenimines having an inner polyethylene oxide block and an outer polypropylene oxide block, the degree of ethoxylation and the degree of propoxylation not going above or below specific limiting values. Specific embodiments of the alkoxylated polyalkylenimines according to the present invention have a minimum ratio of polyethylene) blocks to polypropylene blocks (n/p) of about 0.6 and a maximum of about $1.5(x+2y+1)^{1/2}$. Alkoxylated polyalkylenimines having an n/p ratio of from about 0.8 to about $1.2(x+2y+1)^{1/2}$ have been found to have especially beneficial properties.

The alkoxylated polyalkylenimines according to the present invention have a backbone which consists of primary, secondary and tertiary amine nitrogen atoms which are attached to one another by alkylene radicals A and are randomly arranged. Primary amino moieties which start or terminate the main chain and the side chains of the polyalkylenimine backbone and whose remaining hydrogen atoms are subsequently replaced by alkylenoxy units are referred to as repeating units of formulae (I) or (IV), respectively. Secondary amino moieties whose remaining hydrogen atom is subsequently replaced by alkylenoxy units are referred to as repeating units of formula (II). Tertiary amino moieties which branch the main chain and the side chains are referred to as repeating units of formula (III).

Since cyclization can occur in the formation of the polyalkylenimine backbone, it is also possible for cyclic amino moieties to be present to a small extent in the backbone. Such polyalkylenimines containing cyclic amino moieties are of course alkoxylated in the same way as those consisting of the noncyclic primary and secondary amino moieties.

The polyalkylenimine backbone consisting of the nitrogen atoms and the groups $A^1$, has an average molecular weight Mw of from about 60 to about 10,000 g/mole, preferably from about 100 to about 8,000 g/mole and more preferably from about 500 to about 6,000 g/mole.

The sum (x+2y+1) corresponds to the total number of alkylenimine units present in one individual polyalkylenimine backbone and thus is directly related to the molecular weight of the polyalkylenimine backbone. The values given in the specification however relate to the number average of all polyalkylenimines present in the mixture. The sum (x+2y+2) corresponds to the total number amino groups present in one individual polyalkylenimine backbone.

The radicals $A^1$ connecting the amino nitrogen atoms may be identical or different, linear or branched $C_2$-$C_6$-alkylene radicals, such as 1,2-ethylene, 1,2-propylene, 1,2-butylene, 1,2-isobutylene, 1,2-pentanediyl, 1,2-hexanediyl or hexamethylen. A preferred branched alkylene is 1,2-propylene. Preferred linear alkylene are ethylene and hexamethylene. A more preferred alkylene is 1,2-ethylene.

The hydrogen atoms of the primary and secondary amino groups of the polyalkylenimine backbone are replaced by alkylenoxy units of the formula (V).

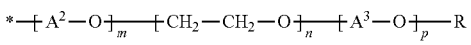

(V)

In this formula, the variables preferably have one of the meanings given below:

$A^2$ in each case is selected from 1,2-propylene, 1,2-butylene and 1,2-isobutylene; preferably $A^2$ is 1,2-propylene. $A^3$ is 1,2-propylene; R in each case is selected from hydrogen and $C_1$-$C_4$-alkyl, such as methyl, ethyl, n-propyl, isopropyl, n-butyl, isobutyl and tert.-butyl; preferably R is hydrogen. The index m in each case has a value of 0 to about 2; preferably m is 0 or approximately 1; more preferably m is 0. The index n has an average value in the range of from about 20 to about 50, preferably in the range of from about 22 to about 40, and more preferably in the range of from about 24 to about 30. The index p has an average value in the range of from about 10 to about 50, preferably in the range of from about 11 to about 40, and more preferably in the range of from about 12 to about 30.

Preferably the alkylenoxy unit of formula (V) is a non-random sequence of alkoxylate blocks. By non-random sequence it is meant that the $[-A^2-O—]_m$ is added first (i.e., closest to the bond to the nitrogen atom of the repeating unit of formula (I), (II), or (III)), the $[—CH_2—CH_2—O—]_n$ is added second, and the $[-A^3-O—]_p$ is added third. This orientation provides the alkoxylated polyalkylenimine with an inner polyethylene oxide block and an outer polypropylene oxide block.

The substantial part of these alkylenoxy units of formula (V) is formed by the ethylenoxy units $—[CH_2—CH_2—O)]_n—$ and the propylenoxy units $—[CH_2—CH_2(CH_3)—O]_p—$.

The alkylenoxy units may additionally also have a small proportion of propylenoxy or butylenoxy units $-[A^2-O]_m—$, i.e. the polyalkylenimine backbone saturated with hydrogen atoms may be reacted initially with small amounts of up to about 2 mol, especially from about 0.5 to about 1.5 mol, in particular from about 0.8 to about 1.2 mol, of propylene oxide or butylene oxide per mole of NH— moieties present, i.e. incipiently alkoxylated.

This initial modification of the polyalkylenimine backbone allows, if necessary, the viscosity of the reaction mixture in the alkoxylation to be lowered. However, the modification generally does not influence the performance properties of the alkoxylated polyalkylenimine and therefore does not constitute a preferred measure.

Preferably the composition comprise from about 0.1% to about 5%, more preferably from about 0.25% to about 2.5% by weight of the composition of an amphiphilic alkoxylated grease cleaning polymer.

Suitable random graft co-polymers typically comprise: (i) hydrophilic backbone comprising monomers selected from the group consisting of: unsaturated $C_1$-$C_6$ carboxylic acids, ethers, alcohols, aldehydes, ketones, esters, sugar units, alkoxy units, maleic anhydride, saturated polyalcohols such as glycerol, and mixtures thereof; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof.

The polymer preferably has the general formula:

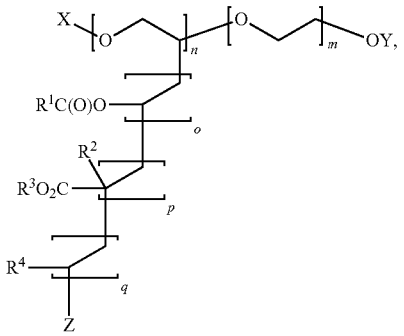

wherein X, Y and Z are capping units independently selected from H or a $C_{1-6}$ alkyl; each $R^1$ is independently selected from methyl and ethyl; each $R^2$ is independently selected from H and methyl; each $R^3$ is independently a $C_{1-4}$ alkyl; and each $R^4$ is independently selected from pyrrolidone and phenyl groups. The weight average molecular weight of the polyethylene oxide backbone is typically from about 1,000 g/mol to about 18,000 g/mol, or from about 3,000 g/mol to about 13,500 g/mol, or from about 4,000 g/mol to about 9,000 g/mol. The value of m, n, o, p and q is selected such that the pendant groups comprise, by weight of the polymer at least 50%, or from about 50% to about 98%, or from about 55% to about 95%, or from about 60% to about 90%. The polymer useful herein typically has a weight average molecular weight of from about 1,000 to about 100,000 g/mol, or preferably from about 2,500 g/mol to about 45,000 g/mol, or from about 7,500 g/mol to about 33,800 g/mol, or from about 10,000 g/mol to about 22,500 g/mol.

EXAMPLE

Process for Making a Base Detergent

A 10 liter batch tank with an aspect ratio of about 1.3 (height to diameter) is fitted with an impeller mixer and is charged with the following:

1.) pre-neutralized sulphate detersive surfactant syrup composed of MEA:C12-15 EO3SO3H, ethanol and propylene glycol
2.) pre-neutralized sulphate detersive surfactant syrup composed of MEA:C16-17 Highly Soluble Alkyl Sulfate, ethanol and propylene glycol
3.) organic solvent composed of ethanol; propylene glycol and diethylene glycol.
4.) neutralizing agent (mono-ethanolamine)

Stirring is commenced at this point and additions are continued

5.) brightener premix composed of brightener chromaphore active, C12-14$(EO)_9$OH non-ionic surfactant; mono-ethanolamine and water
6.) MEA-Boric acid premix composed of Boric acid, mono-ethanolamine and water
7.) Amine Oxide composed of C12-14 dimethylamine N-oxide and water
8.) Ethoxylated Polyamine Dispersant polymer (80 wt % active, 20 wt % water)
9.) Amphiphilic alkoxylated grease cleaning polymer (100% active)
10.) Diethylene triamine penta acetic acid penta sodium salt (DTPA) premix (50 wt % DTPA, 50 wt % water)
11.) 1,2-dihydroxybenzene-3,5-disulfonic acid premix (50 wt % active)
12.) Calcium formate premix (10 wt % active)

Cooling is applied if needed during the next addition steps to maintain a maximum temperature of less than 37° C.

13.) C12-18 Fatty acid
14.) C11.8 HLAS (alkyl benzene sulphonate)

Process for Making a Detergent Composition

The base detergent is converted to finished detergent by continued stirring and addition of:

15.) water
16.) perfume
17.) Hueing dye premix (0.32% active chromaphore)
18.) enzyme premix
19.) Suds suppression polymer
20.) structurant
21.) Mica pearlescent particles The detergent presents a good rheological profile and it is very stable.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making an anhydrous laundry liquid detergent base composition comprising a sulphate detersive surfactant and a sulphonic detersive surfactant, the process comprising the steps of:

a. providing a pre-neutralized sulphate detersive surfactant syrup wherein at least 50% by weight of the sulphate detersive surfactant is pre-neutralized with an organic neutralizing agent;
b. adding a neutralizing agent to the sulphate detersive surfactant syrup; and
c. adding a sulphonic detersive surfactant in acid form to the mixture resulting from step b).

2. The process according to claim 1 wherein the neutralizing agent is an alkanolamine.

3. The process according to claim 1 wherein the sulphate detersive surfactant is selected from the group of alkyl alkoxylated sulphates, mid-chain branched primary alkyl sulphates and mixtures thereof.

4. The process according to claim 1 wherein the sulphate detersive surfactant comprises at least 50% by weight of alkyl alkoxylated sulphate.

5. The process according to claim 1 wherein the pre-neutralized sulphate detersive surfactant syrup comprises an organic solvent.

6. The process according to claim 1 wherein the neutralizing agent of step b) is selected from the group of organic neutralizing agents, inorganic neutralizing agents and mixtures thereof.

7. The process according to claim 1 comprising the step of adding an organic solvent after step a) and before step b).

8. The process according to claim 1 wherein the sulphate detersive surfactant and the sulphonic detersive surfactant are present in the base composition at a weight ratio of from about 4:1 to about 1:1.

9. The process for making a laundry liquid detergent according to claim 1 further comprising the step of post-adding from about 5 to about 20% by weight of water to the base composition.

10. A process for making an anhydrous laundry liquid detergent base composition comprising a sulphate detersive surfactant and a sulphonic detersive surfactant, the process comprising the steps of:

a. providing a pre-neutralized sulphate detersive surfactant syrup comprising a sulphate detergent surfactant and a solvent, wherein at least 50% by weight of the sulphate detersive surfactant is pre-neutralized with an organic neutralizing agent;
b. adding a neutralizing agent to the sulphate detersive surfactant syrup; and
c. adding a sulphonic detersive surfactant in acid form to the mixture resulting from step b).

11. The process according to claim 10, wherein the solvent is a non-amino functional solvent.

12. The process according to claim 11, wherein the non-amino functional solvent is a mixture comprising ethanol and propylene glycol.

* * * * *